United States Patent [19]

Spengler

[11] 4,193,726

[45] Mar. 18, 1980

[54] APPARATUS FOR HANDLING OF FLAT GOODS

[75] Inventor: Ernst Spengler, Heusenstam by Frankfurt, Fed. Rep. of Germany

[73] Assignee: Stanztechnik GmbH R & S, Frankfurt, Fed. Rep. of Germany

[21] Appl. No.: 911,337

[22] Filed: Jun. 1, 1978

[51] Int. Cl.[2] ..... B65G 59/02

[52] U.S. Cl. ..... 414/114; 414/117

[58] Field of Search ..... 414/786, 112, 114, 117; 271/73, 191

[56] References Cited

U.S. PATENT DOCUMENTS

| | | | |
|---|---|---|---|
| 2,854,150 | 9/1958 | Shea | 414/117 X |
| 3,017,041 | 1/1962 | Hawkes | 414/786 X |

*Primary Examiner*—Stephen G. Kunin
*Assistant Examiner*—George F. Abraham
*Attorney, Agent, or Firm*—W. G. Fasse; D. F. Gould

[57] ABSTRACT

Flat goods such as sheets of cardboard are destacked or removed from a stack for the purpose of further processing, especially in stamping, cutting, or break-out devices. A carrier is introduced into the stack. The carrier has a surface which remains stationary relative to that portion of the stack which is being removed when the carrier is withdrawn from the stack. For this purpose the carrier which is supported in a frame, is provided with a surface which is movable relative to the carrier. The movable surface is guided at least around the leading edge of the carrier.

8 Claims, 7 Drawing Figures

APPARATUS FOR HANDLING OF FLAT GOODS

BACKGROUND OF THE INVENTION

The present invention relates to an apparatus for destacking or removing sheet-like flat goods from a stack such as a stack of cardboard sheets or the like. The invention is especially suitable for cooperation with stamping, cutting or break-out devices.

Flat goods such as paper or cardboard sheets in their already stamped condition or in the initial, unstamped condition, are usually stored and transported in stacks and it becomes frequently necessary to destack such materials for further processing. Such destacking is necessary, for example, for removing individual sheets or layers from a stack and also for the purpose of making partial stacks, whereby each partial stack comprises several individual layers.

It is known to use fork-lifts, for example, for destacking work. However, the insertion of the fork frequently causes damage to the stacked material which is undesirable especially where each sheet of a stack itself is already expensive, for example, such as sheets of panelling and the like. It has been found that the damage results from the fact that the fork or the carrier has a surface which moves relative to the stack portion being removed as the fork or carrier is inserted into the stack.

OBJECTS OF THE INVENTION

In view of the foregoing, it is the aim of the invention to achieve the following objects, singly or in combination:

to provide an apparatus for destacking sheet goods by means of which it is possible to remove single sheets or a plurality of sheets from a stack in a gentle manner, whereby the sheets will not be damaged;

to provide an apparatus which is capable to remove a plurality of smaller stacks from a larger stack of sheet goods without damaging any of the sheets in any of the stacks; and to provide the carrier with a flexible belt surface secured in such a manner that the belt may remain relatively stationary with regard to the stack portion being removed while being movable relative to the carrier.

SUMMARY OF THE INVENTION

The apparatus of the invention operates by first pushing a carrier into a stack whereby the surface of the carrier remains stationary at least relative to the stacked portion to be removed. Thereafter, the lifted stack portion on the carrier is removed, whereby this may be accomplished either directly with the carrier or by displacing a partial stack on the carrier.

The apparatus according to the invention is characterized in that a flexible cover member forms at least a portion of the surface of the shiftable carrier and that the flexible cover member is guided around the leading edge of the carrier which penetrates into a stack, whereby the flexible cover member is also movable relative to the carrier. Preferably, the flexible cover member is a belt or it comprises a plurality of louvers interconnected to form a belt type structure. One end of the belt is rigidly connected to a portion of the apparatus, whereas the other end of the belt is arranged so that the belt may yield, whereby the cover portion of the belt may come to rest on the carrier when the latter is pushed into a stack. Thus, a relative motion between the cover portion of the belt and the stack portion to be removed is avoided.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
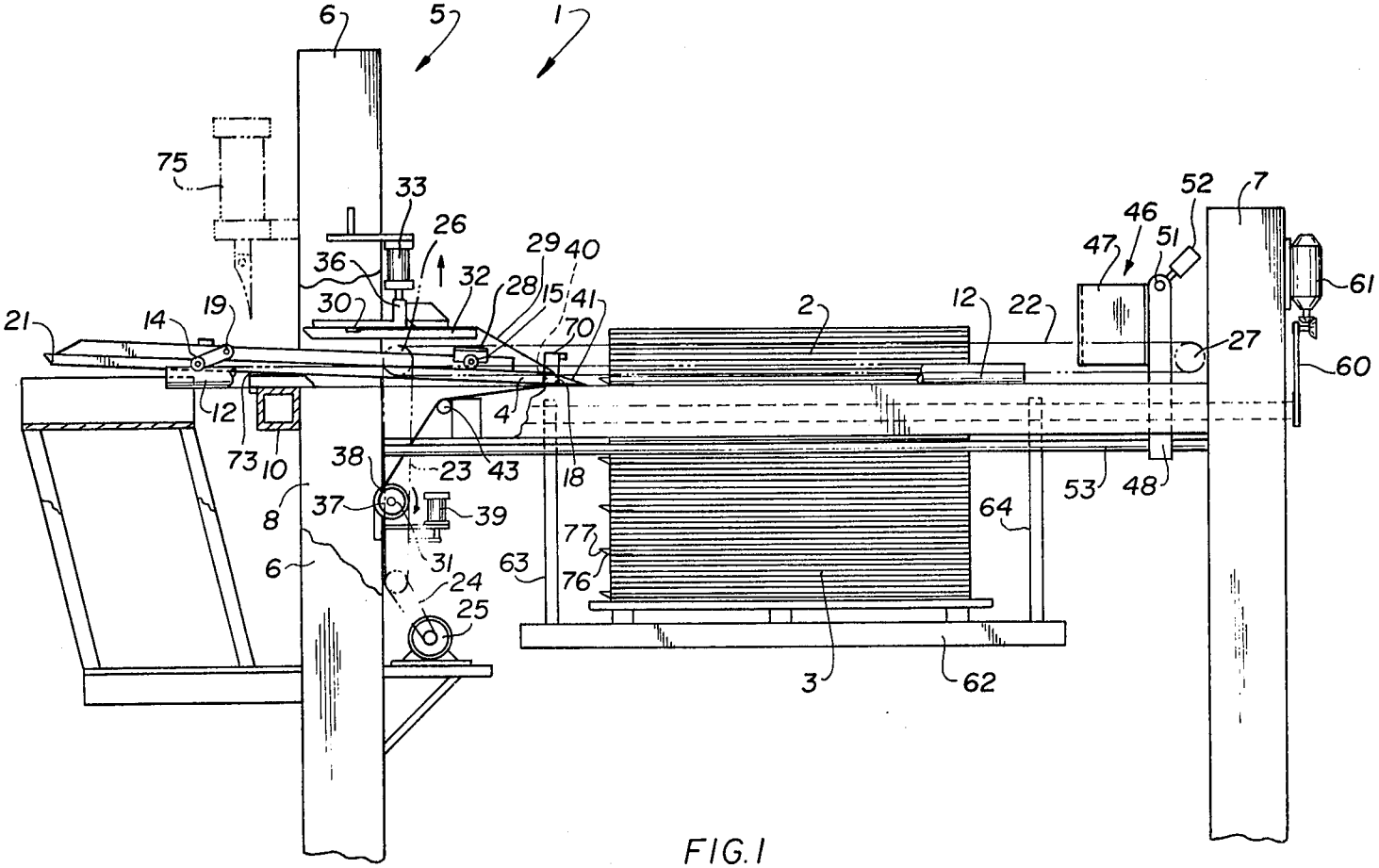
FIG. 1 is a somewhat simplified side view of an apparatus according to the invention illustrating the carrier and the cover belt in a position prior to inserting the carrier into a stack of sheet or flat goods.

FIG. 1 illustrates an apparatus 1 according to the invention for destacking of sheet or panel type goods or for the removal of a partial stack 2 from a larger stack 3. The apparatus comprises a carrier 4 which is supported in the machine frame 5 for lateral displacement into the stack 3. The machine frame 5 comprises vertical, upright supporting posts 6 and 7 as well as 8 and 9, please see FIG. 5. The uprights are operatively interconnected by rigid horizontal frame members 10 and 11 to form the rigid frame 5, for example, by welding or the like. The carrier 4 is horizontally displaceable in the machine frame 5. For this purpose there are provided two guide rods 12 and 13 on which the carrier 4 may be displaced on rollers 14 and 15 as well as 16 and 17. One pair of rollers or runners 14 and 16 is pivotally secured to the carrier 4 by means of tilting arms 19 and 20 in such a manner that the carrier 4 in its withdrawn position shown in FIG. 1 is able to be tilted upwardly with its rear end or edge 21. This pair of rollers 14 and 16, as compared to the pair of rollers 15 and 17 is more remote from the forward edge 18 of the carrier 4 by means of which the carrier 4 enters into the stack 3. The carrier 4 as described above, forms with its rollers 14, 15 and 16, 17, a carriage which is displaceable by means of a chain drive comprising two endless rotating chains 22 arranged alongside the carrier 4 and two further revolving chains 23 and 24 driven by a motor 25.

The two runs of the chains 22 extend in parallel to the guide rod 12 and run over gear wheels 26, 27 which are arranged laterally outside the carrier 4. Cam means 28 are secured to one run of the chain 22, preferably the upper run. The cam means 28 engage the carrier 4 for shifting the latter back and forth in accordance with the movement of the chains 22.

According to the invention a cover member 29 extends around the leading or forward edge 18 of the carrier 4. The cover member 29 is guided around the forward edge 18 and has a width corresponding substantially to that of the carrier 4. In the alternative the cover member 29 may be somewhat narrower than the carrier 4. The cover member 29 may be a flexible belt or it may be constructed in the form of blinds from a plurality of rods or the like. As illustrated in the drawings, the shown example for the cover member 29 is a flexible belt which may be wound up on a roller.

Figure 4:
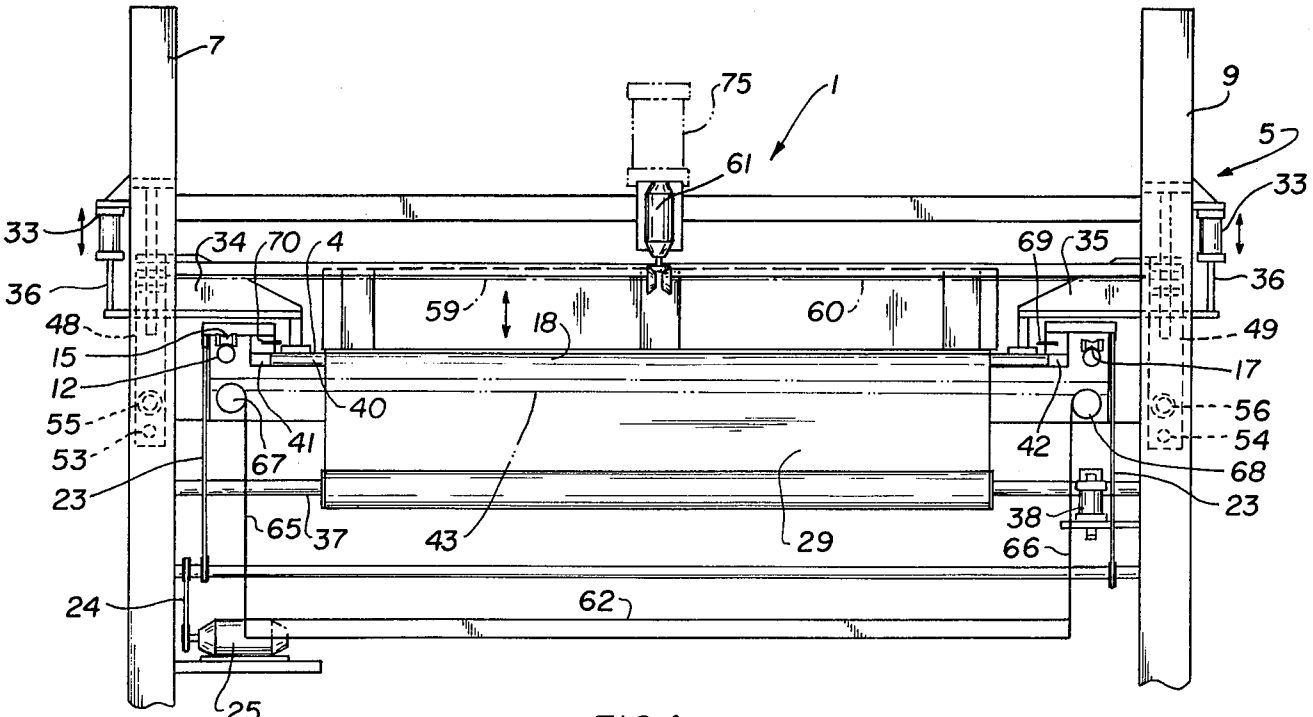
FIG. 4 illustrates a rear view of the apparatus according to the invention whereby certain components have been omitted for simplicity's sake.

One end 30 of the belt cover member 29 is rigidly connected to the machine structure. The other end 31 is yieldably secured as will be described in more detail below. The rigid end 30 is secured to a table top 32 which may be lifted above the level of the carrier 4 by means of a piston cylinder arrangement 33, preferably of the hydraulic kind. The arrangement is such, that the cover member 29 may be brought exactly to the level of the carrier 4 so that the cover member 29 is aligned with the carrier 4, whereby the cover member 29 extends substantially coextensively with the carrier 4 in which position the cover member 29 may be lowered with the carrier 4. Brackets 34 and 35, best seen in FIG. 4 connect the piston rods 36 of the hydraulic piston cylinder devices 33 with the table top 32.

The second yieldingly secured end 31 of the belt cover member 29 may be wound onto the roller 37 as mentioned above. The roller 37 has a tendency to keep the cover member 21 tight under the influence of a return spring not shown which acts in the same manner as self returning window blinds. A belt brake 38 is operatively connected to the belt cover member 29 and also to the motor 39 which thus makes sure that the belt cover member 29 is always kept under a high bias tensioning. The leading edge 18 of the carrier 4 comprises a guide roller 40 and the cover member 29 leads around this guide roller 40. Further, two separator wedges 41, 42 are arranged adjacent the outer ends of the leading edge 18 and the roller 14 for the cover member 29. The wedges 41, 42 make sure that the cover member 29 runs properly around the leading edge of the carrier 4.

Figure 2:
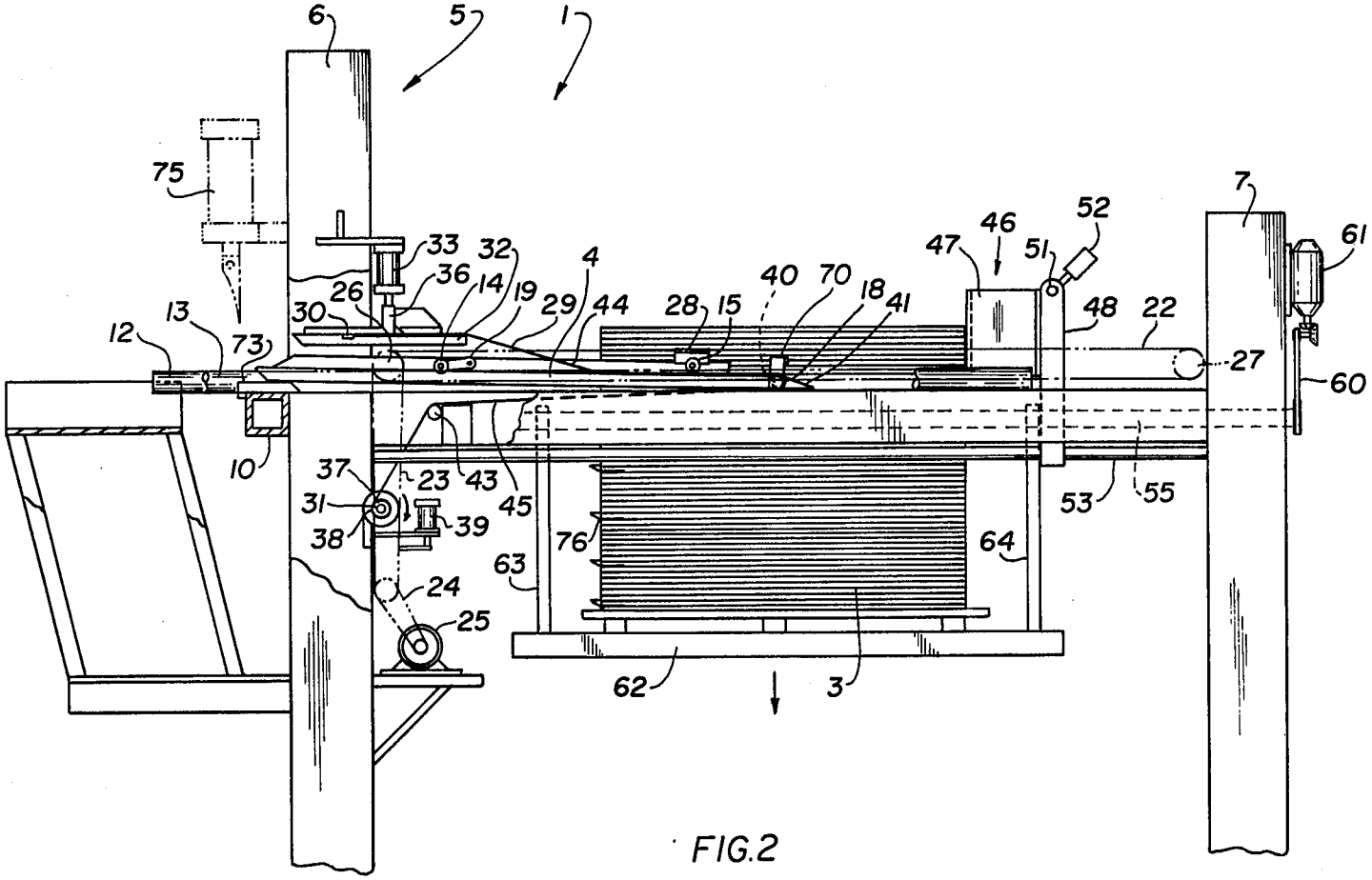
FIG. 2 illustrates the same side view as FIG. 1, however, with the carrier partially inserted into a stack.
Figure 3:
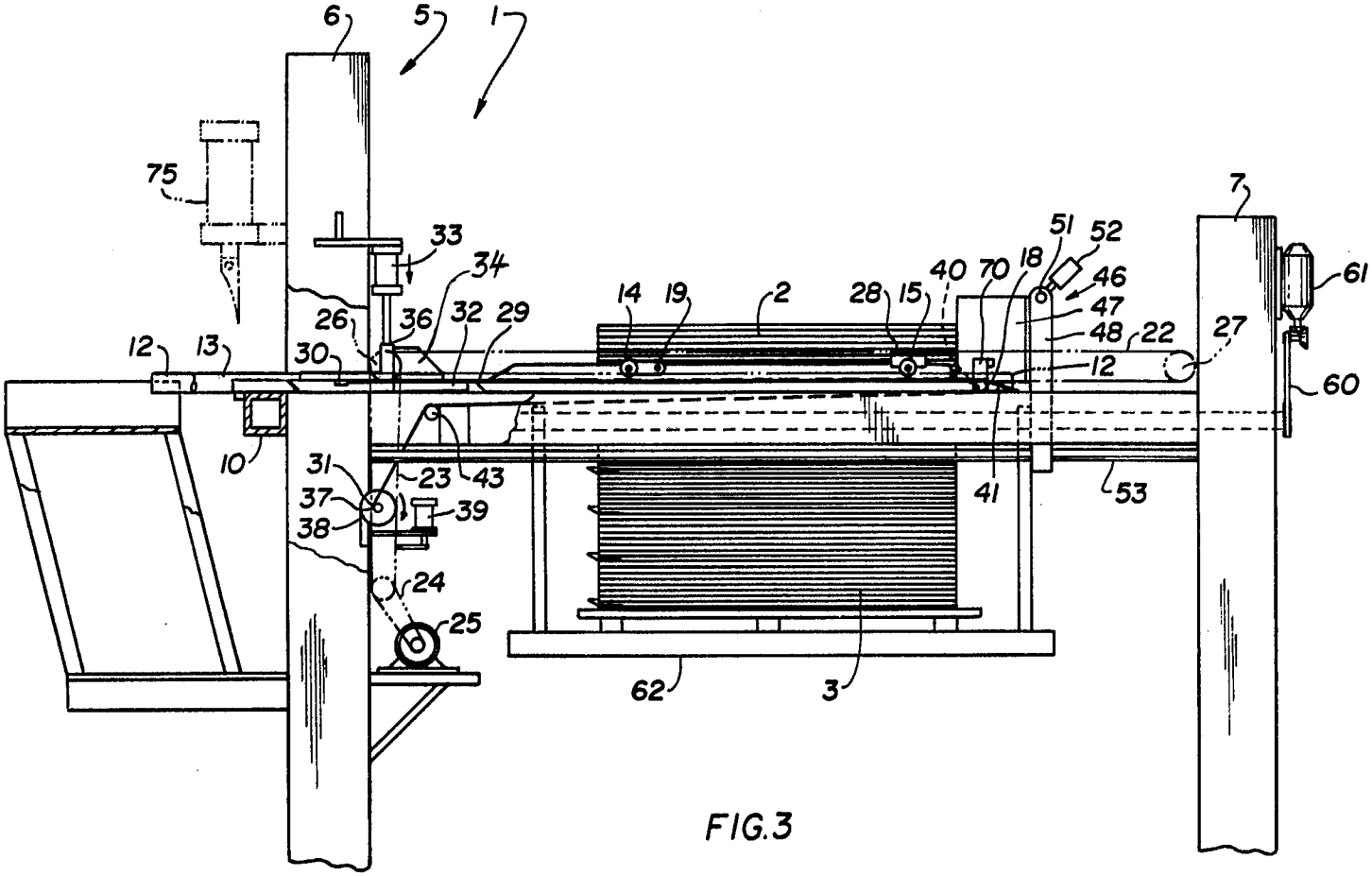
FIG. 3 is a view similar to that of FIGS. 1 and 2 however with the carrier fully inserted into a stack.

In the starting position shown in FIG. 1, the carrier 4 has been moved all the way to the left and the table top 32 is shown in its lifted position. The cover member 29 covers most of the table top 32 and extends from the leading edge of the table of 32 to the edge 18 of the cover member 29. From the edge 18 the belt cover member 29 runs over the guide roller 43 to the take up roller 37 located underneath the carrier 4. As the carrier 4 is moved to the right into the stack 3 as shown in FIGS. 2 and 3, the cover member 29 hugs the top and bottom surfaces of the carrier 4 as may be best seen by comparing FIGS. 1 and 3. During this motion of the carrier 4, the cove member 29 remains stationary relative to the underside of the stack portion 2 which is to be lifted. This is so because the cover member 29 is rigidly secured with its rear edge or end 30 to the table top 32. A relative motion takes place only between the carrier 4 and the top portion 44 as well as the bottom portion 45 of the cover member 29. This relative motion between the carrier 4 and the cover member 29 continues until the carrier 4 reaches the position shown in FIG. 3.

Figure 5:
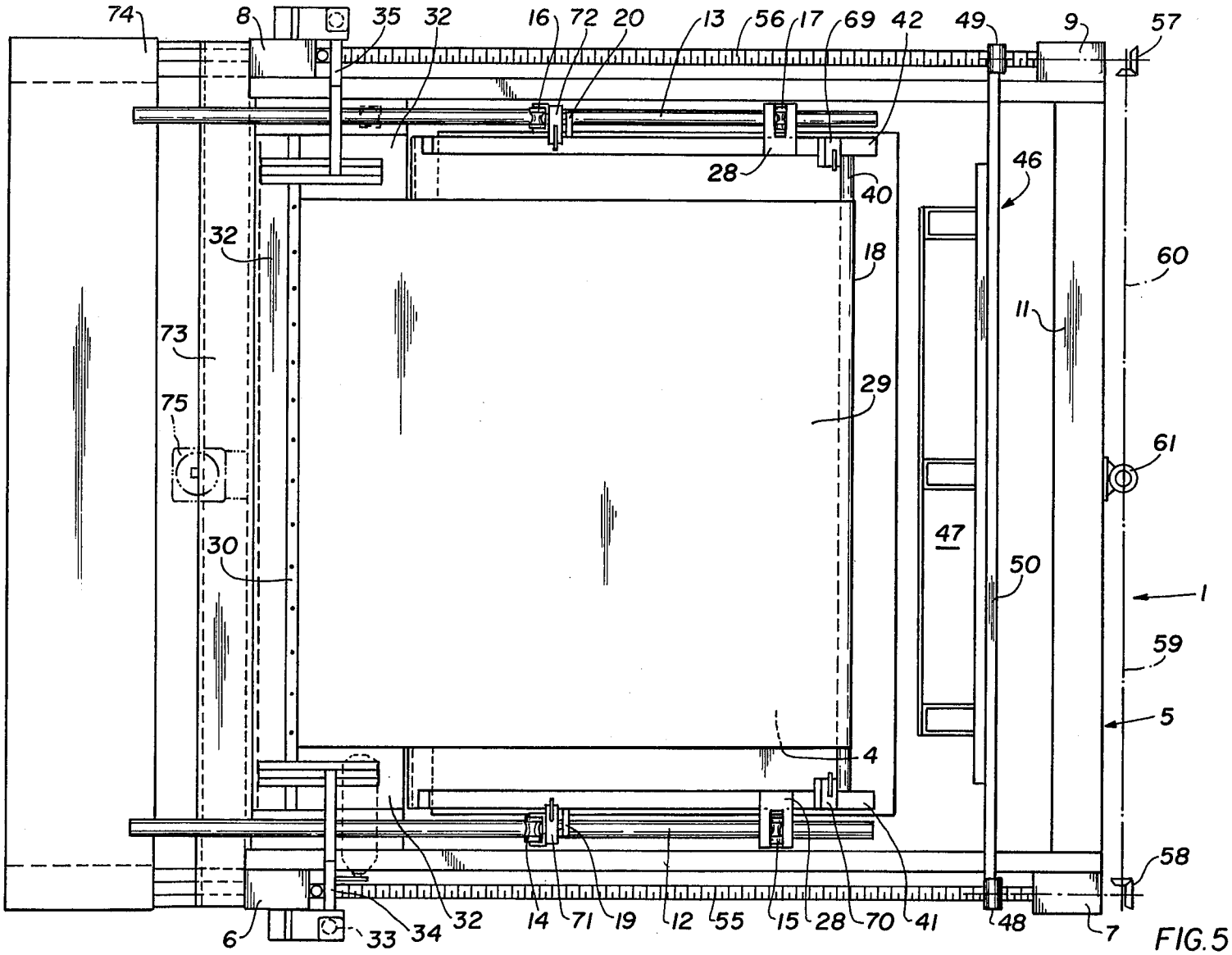
FIG. 5 illustrates a top plan view of the apparatus according to the invention.
Figure 6:
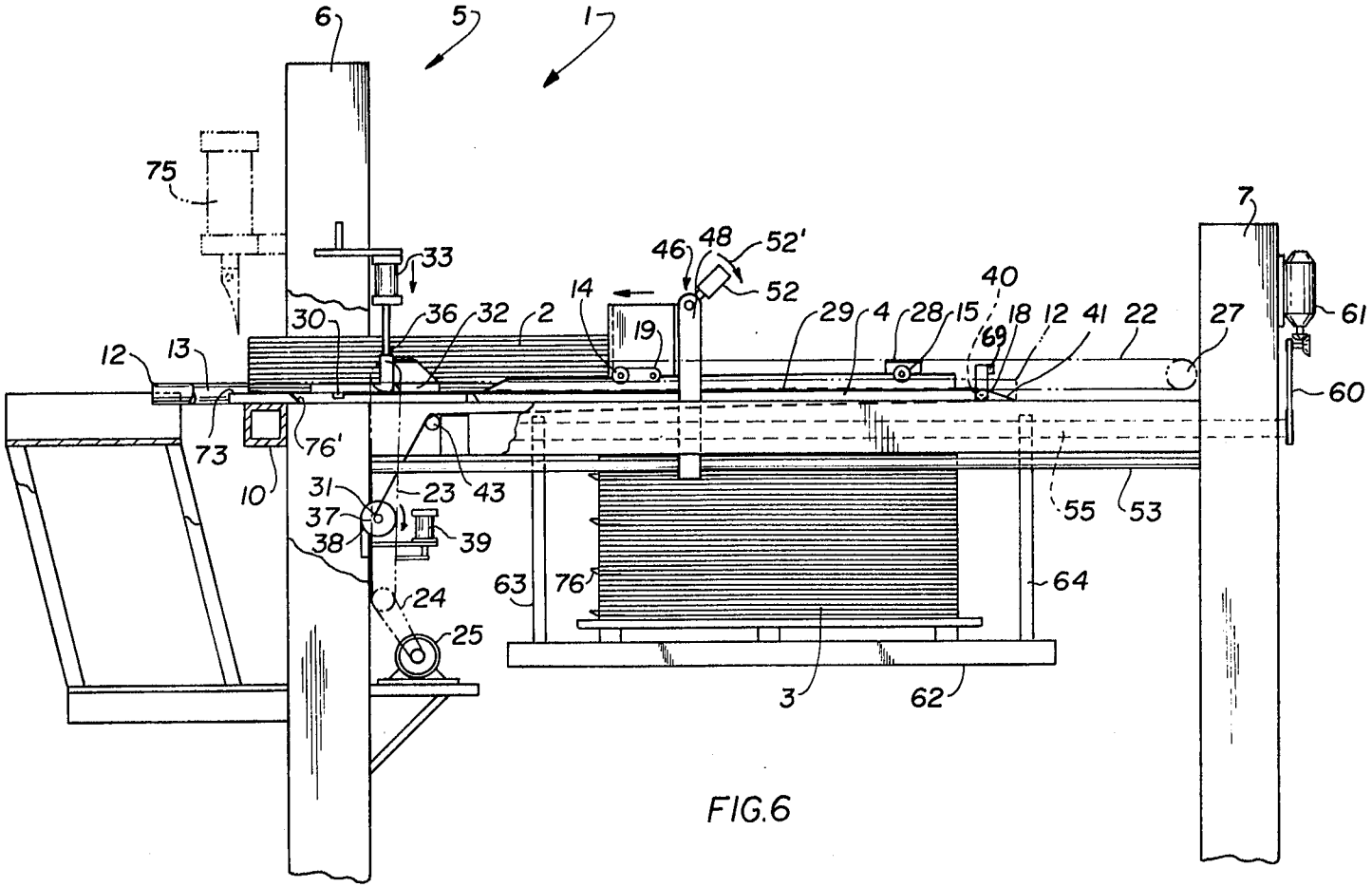
FIG. 6 illustrates a view similar to that shown in FIG. 3 however showing a pusher member in operation for removing a lifted stack portion from the carrier.

The apparatus 1 according to the invention further comprises a holding and pushing mechanism for removing a lifted sheet or stack portion from the top of the carrier 4 as best seen, for example, in FIG. 6. The apparatus 46 comprises a pusher member 47 which is secured to two drive members 48 and 49 as seen in FIGS. 1 and 5. More specifically, the pusher member 47 is secured in an exchangeable or replaceable manner to a support member 50 which in turn is secured through journal bearings 51 shown in FIG. 1. As shown in FIGS. 1, 2, and 3 a counter-weight 52 is also operatively secured to the support member 50 whereby the pusher member 47 may be held in a lifted position, in other words, in an upwardly tilted position with the counter-weight 52 pointing downwardly. The lifting is accomplished by moving the counter-weight 52 in the direction of the arrow 52' as shown in FIG. 6.

The two drive members 48 and 49 are supported in a displaceable manner on guide rods 53 and 54 extending in parallel to the movement direction of the carrier 4. Further, a spindle drive comprising the spindles 55 and 56 is operatively connected for displacing the drive members 48, 49 and thus the pusher member 47. The two spindles 55 and 56 are supported by the upright post 6, 7, 8, and 9 and carry at their ends bevel gears 57 and 58 cooperating with respective bevel gears secured to drive shafts 59 and 60 driven by a motor 61. When the motor 61 is energized, the spindles 55 and 56 are rotated and thus displace the pusher 47 through the drive members 48 and 49.

The stack 3 rests on a stacking table 62 which is adjustable in its elevational position by means of guide rods 63, 64 in the machine frame 5. Further, the stacking table 62 is suspended by chains 65 and 66. A total of four such chains 65 and 66 cooperate with chain drive sprocket wheels 67 and 68 which are driven in synchronism with each other by a common motor not shown since such drives are well known in the art.

The present apparatus operates as follows. In order to destack individual sheets or panels or a portion of a larger stack, the stacking table 62 is first elevated to the desired level so that a predetermined number of layers or sheets or panels of the goods to be destacked will be located above the elevation of the carrier 4. FIG. 1 illustrates this situation. The elevation of the stacking table 2 may be adjusted in very fine steps so as to control the number of sheets or the like to be removed from the larger stack.

After the stacking table 62 has been brought into the desired elevated position, the holding and shifting device 46 is brought into a position in contact against the partial stack 2 to be removed from the larger stack 3 as shown in FIGS. 2 and 3. Thereafter the carrier 4 is shifted horizontally by means of the chains 22 toward the stack 3 and into the stack 3 until the partial stack 2 is completely located on the carrier 4 or rather, on the cover member 29 as shown in FIG. 3.

Immediately upon the contacting of the leading edge 18 of the carrier 4 with the stack 3, the latter is lowered by a distance corresponding substantially to the thickness of the carrier 4 in the cover member 29. The control for this lowering of the stack 3 is accomplished by means of photocells 69, 70 which are secured at the outer edges of the carrier 4 adjacent to the leading edge 18 of the carrier 4. The photocells control the drive means for the stacking table 62. The stack 3 is further lowered when the partial stack 2 is about one half on the carrier 4 as shown in FIG. 2. This second lowering of the stack 3 is also controlled by a further set of photocells 71, 72 which are located about at the elevation of the rear running rollers 14 and 16.

When the carrier 4 has reached its most forward position as shown in FIG. 3, the table top 32 is lowered to such an elevation that a closed supporting surface is established from the leading edge 18 of the carrier 4 to the upright posts 6 and 8 and beyond these posts to a fixed work surface 73 which, for example, merges into a further fixed table top 74 as best seen in FIG. 5. At this point of the operation the partial stack 2 which has been removed from the stack 3 may now be shifted by means of the holding and pushing mechanism 46 onto the support member 29 to any desired extent. The partial stack 2 may now be either directly transported to a work tool 75 such as a break-out mechanism for folding box blanks or the like. In the alternative, the partially removed stack 2 may be prepared in any other desired manner for further processing or for further transporting.

The further operation of the present apparatus is as follows. First, the table top 32 is raised and the carrier 4 is returned into the initial position, whereby the rear edge 21 which has a slanted portion ridges upwardly on the also slanted forward edge 76' of the work surface 73 until the position shown in FIG. 1 is reached. Simultaneously, the holding and shifting device 46 is moved back to the righthand position shown in FIG. 1 and then the stacking table 62 is raised until its stack has reached an elevation such that the desired number of stacked elements extends above the level of the carrier 4. Thereupon, the above described destacking operation is repeated.

Figure 7:
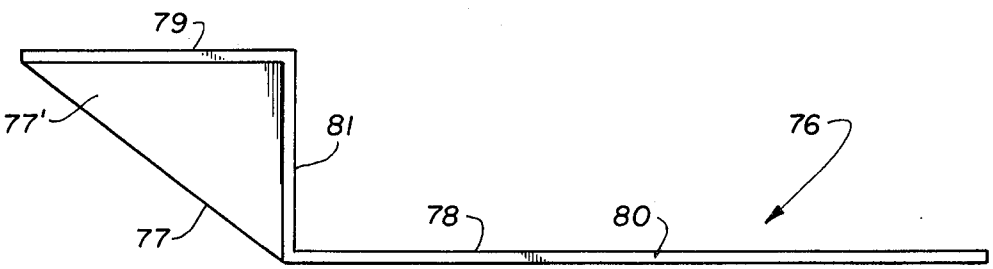
FIG. 7 is a side view of a lifting molding insertable into the stack.

The penetration of the carrier 4 with its forward or leading edge 18 into the stack 3 is facilitated by lift moldings 76, one example of which is shown in FIG. 7. These lift moldings 76 are inserted into the stack 3 prior to placing a stack on the stacking table 2, whereby a suitable number of such moldings may be used which are placed at the desired spacings corresponding to the height of the individually separated smaller stacks 2.

The lift moldings 76 have about a width or length corresponding to that of the width of the supporting member 29. Each molding is provided with a slanted guide surface 77 which comes into contact with the carrier 4 or rather with the cover member 29 as the carrier 4 advances to the right. Thus, the slanted surface 77 guides the separation wedges 41 and 42 or it guides the belt cover member 29 which runs around the guide rollers 40 at the leading edge 18 of the carrier 4. With the aid of the lift moldings 76 a trouble-free separation of the partial stack 2 from the stack 3 may be accomplished since the carrier 4 penetrates without difficulty into the stack 3 at the desired location.

As shown in FIG. 7 the lift molding 76 comprises a strip of sheet metal 78 which has been bent twice at right angles to provide a horizontal section 79, a vertical section 81, and another horizontal section 80. The vertical section 81 and the horizontal section 79 form together with a metal gusset 77', which may be welded to the bent strips 79, 81, the slanted surfaces 77. The longer horizontal section 80 of the lift molding 76 is pushed into the stack 3 intermediate of two layers thereof until the vertical section 81 contacts the stack 3.

The foregoing specification describes certain examples. However, modifications may be made without departing from the present teachings. Thus, the cover member 21 may be modified by providing it preferably with a coating of "Teflon" (RTM) or the like. The cover member 29 may be made, for example, from a textile webbing coated with "Teflon" (RTM) and provided with burl type protrusions which facilitate the holding of a partial stack on the carrier 4.

Although the invention has been described with reference to specific example embodiments, it will be understood, that it is intended to cover all modifications and equivalents within the scope of the appended claims.

What is claimed is:

1. An apparatus for handling portions of a stack of sheet or panel goods, comprising machine frame means, carrier means, means supporting said carrier means for horizontal movement in said machine frame means, stack support means operatively arranged relative to said machine frame means for cooperation with said carrier means, and cover means arranged for cooperation with said carrier means in such a manner that upon moving said carrier means into said stack, part of said cover means that is in contact with the portion of said stack, that is being separated from the stack, is stationary relative thereto.

2. The apparatus of claim 1, further comprising means operatively arranged in said machine frame means for removing said separated stack portion as it rests on said cover means and thus on said carrier means.

3. The apparatus of claim 1, wherein said carrier means comprise a forward edge, said apparatus further comprising guide means which lead said cover means around said forward edge of said carrier means to permit relative movement between said carrier means and said cover means.

4. The apparatus of claim 3, wherein said cover means comprise a flexible belt having a rear end and a forward end, said apparatus further comprising means rigidly securing said rear end of said flexible belt to said machine frame means, and further means movably securing said forward end of said flexible belt to said machine frame means whereby movement of said carrier means against said flexible belt places the top portion of said flexible belt substantially into surface contact with the top surface of said carrier means.

5. The apparatus of claim 1, wherein said carrier means comprise a plate suitable for holding a separated stack portion thereon.

6. The apparatus of claim 1, further comprising lift molding means having a horizontal portion insertable in a stack, a vertical portion adapted to rest against the side of a stack and a slanted portion for engagement by said carrier means when the latter are moved into a stack.

7. The apparatus of claim 1, further comprising stacking table means in said machine frame means, and means for raising and lowering said stacking table means.

8. The apparatus of claim 1, further comprising pusher means in said machine frame movable relative to said carrier means for pushing said separated stack portion along said carrier means.

* * * * *